US008139998B2

(12) United States Patent
Hayasaka et al.

(10) Patent No.: US 8,139,998 B2
(45) Date of Patent: Mar. 20, 2012

(54) SHEET PROCESSING APPARATUS AND IMAGE FORMING APPARATUS

(75) Inventors: Takaharu Hayasaka, Toride (JP); Hideki Kushida, Moriya (JP); Kenichi Hayashi, Abiko (JP); Hitoshi Fujimoto, Abiko (JP); Shigeo Doi, Toride (JP)

(73) Assignee: Canon Kabushiki Kaisha (JP)

( * ) Notice: Subject to any disclaimer, the term of this patent is extended or adjusted under 35 U.S.C. 154(b) by 906 days.

(21) Appl. No.: 12/170,022

(22) Filed: Jul. 9, 2008

(65) Prior Publication Data

US 2009/0014936 A1 Jan. 15, 2009

(30) Foreign Application Priority Data

Jul. 12, 2007 (JP) ..... 2007-182873

(51) Int. Cl.
*G03G 15/00* (2006.01)

(52) U.S. Cl. ..... 399/407; 399/408; 412/33

(58) Field of Classification Search ..... 399/407, 399/408; 412/34, 38, 40, 33
See application file for complete search history.

(56) References Cited

U.S. PATENT DOCUMENTS

| | | | | |
|---|---|---|---|---|
| 4,213,220 | A * | 7/1980 | Lopez-Martinez | 412/8 |
| 5,966,579 | A * | 10/1999 | Asai et al. | 399/407 |
| 6,688,198 | B2 * | 2/2004 | Matsumoto et al. | 83/139 |
| 2003/0072593 | A1 * | 4/2003 | Kimura et al. | 399/405 |
| 2005/0047894 | A1 * | 3/2005 | Merkli | 412/33 |

FOREIGN PATENT DOCUMENTS

| | | | |
|---|---|---|---|
| JP | 08-142537 | A | 6/1996 |
| JP | 9-165136 | A | 6/1997 |
| JP | 2004-284750 | A | 10/2004 |

OTHER PUBLICATIONS

Japanese Office Action dated Sep. 20, 2011 in counterpart application JP 2007-182873. English translation provided.

* cited by examiner

*Primary Examiner* — Matthew G Marini
(74) *Attorney, Agent, or Firm* — Rossi, Kimms & McDowell LLP

(57) ABSTRACT

The present invention provides a sheet processing apparatus and an image forming apparatus which can achieve reduction of running cost. A notch part forming portion 400A including a punch 403 and a die 404 forms plural notch parts in an end part of a sheet bundle folded by a sheet folding portion. A discharge roller pair 402*a* and 402*b* turns back the notch parts to bind the sheet bundle. As a result, the sheet bundle can easily be opened and the reduction of the running cost can be achieved because stapling is not performed.

19 Claims, 13 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, particularly to a configuration used to bind a sheet bundle.

2. Description of the Related Art

Conventionally, sometimes a sheet processing apparatus performing a binding process to sheets on which images are formed is provided in the image forming apparatus such as a copying machine, a laser beam printer, a facsimile, and a multi function peripheral thereof. Furthermore, in the conventional sheet processing apparatus, sometimes a binding process or a process of gluing end parts of the sheets is performed in the case where the sheet bundle is stapled.

In the conventional image forming apparatus, when the image (information) is formed (printed) on the sheet, sometimes a site at which the image output is instructed is separated from a site at which the image forming apparatus is placed. In such cases, after the image output is instructed, a third party possibly sees the information, while the sheet on which the image is formed is picked up or while the sheet is stored or conveyed, whereby a security problem arises.

Therefore, in order to solve the problem, there is proposed a sheet processing apparatus which discharges the sheet after an open edge opposite a folded part of the folded a sheet (bundle) or an open edge opposite a bound part of the bound sheet bundle is formed partially or wholly in an uncut shape.

Specifically, there is proposed a method in which a stapling process is performed to form the sheet (bundle) in the uncut shape after a perforating process is performed to a part where the open edge of the folded sheet (bundle) is opened (see Japanese Patent Application Laid-Open No. 2004-284750). There is also proposed a method in which the open edge side of the bound sheet bundle is partially or wholly stapled and bound (see Japanese Patent Application Laid-Open No. 09-165136).

However, in the conventional sheet processing apparatus, a staple is required to bind the sheets. As a result, unfortunately running cost is increased, and the apparatus is stopped to lower productivity when the staple is run out.

In the case where the sheet bundle is stapled to form the sheet bundle in the uncut shape, unfortunately a large amount of man-hours is taken to remove the staple when the sheet bundle is opened, and the removed staple becomes a waste stuff.

In view or the foregoing, the present invention provides a sheet processing apparatus and an image forming apparatus which can achieve reduction of the running cost.

SUMMARY OF THE INVENTION

In accordance with an aspect of the invention, a sheet processing apparatus which processes a sheet or a sheet bundle includes a notch part forming portion which forms plural notch parts in an end part of a sheet or a sheet bundle; and a sheet bundle portion which turns back the plural notch parts to bind the sheet or the sheet bundle.

According to the invention, the plural notch parts are formed in the end part of the sheet or the sheet bundle, and the plural notch parts is turned back to bind the sheet or the sheet bundle, so that the reduction of the running cost can be achieved.

Further features of the present invention will become apparent from the following description of exemplary embodiments with reference to the attached drawings.

DESCRIPTION OF THE EMBODIMENTS

Exemplary embodiments of the invention will be described below with reference to the drawings.

Figure 1:
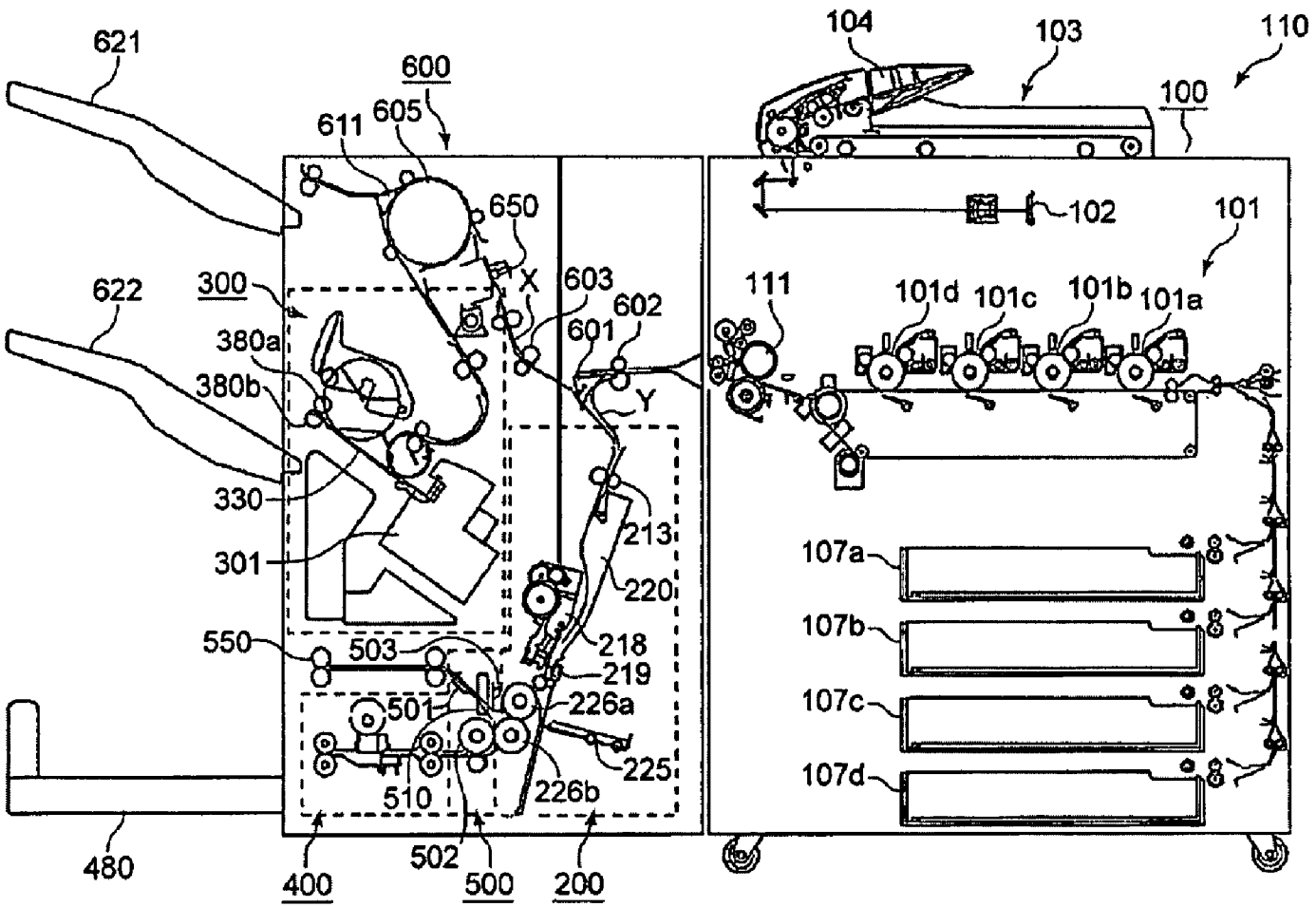
FIG. 1 illustrates a configuration of a copying machine which is of an example of an image forming apparatus provided with a sheet processing apparatus according to a first embodiment of the invention.

FIG. 1 illustrates a configuration of a copying machine which is of an example of an image forming apparatus provided with a sheet processing apparatus according to a first embodiment of the invention.

Referring to FIG. 1, a copying machine main body 100 of a monochrome and color copying machine (hereinafter referred to as copying machine) 110 includes an image forming portion 101, an image sensor 102, and an image reader portion 103. The image reader portion 103 includes an original feeding portion 104. A finisher 600 which is of a sheet processing apparatus is connected to the copying machine main body 100.

In the copying machine 110, when an image is formed on a sheet, an image sensor 102 scans an image of an original (not illustrated) conveyed by the original feeding portion 104 of the image reader portion 103. Then, yellow, magenta, cyan, and black toner images are formed on photosensitive drums 101*a* to 101*d* according to scanned image information respectively.

When a sheet feed signal is supplied, the sheet is fed from cassettes 107*a* to 107*d* provided in the copying machine main body 100 to the image forming portion 101, and the yellow, magenta, cyan, and black toner images on the photosensitive drums are sequentially transferred to the sheet.

Then, the sheet to which the toner images are transferred is conveyed to a fixing device 111. The fixing device 111 permanently fixes the transferred images to the sheet, and a discharge roller pair discharges the sheet from the copying machine main body 100 to convey the sheet to the finisher 600.

The finisher 600 sequentially takes in the sheets discharged from the copying machine main body 100, and the finisher 600 performs a process of aligning the sheets to bind up the sheets into a bundle. Additionally, the finisher 600 performs various processes such as a stapling process of stapling rear ends (upstream end in a sheet conveying direction) of the bound-up sheet bundle, a punch process of making a hole near the rear ends of the sheets, a sort and non-sort process, a folding process of folding the sheet bundle, and a double-folded bookbinding process.

The finisher 600 includes a saddle stitching processing portion 200 which performs a double-folded bookbinding process, a side stitch processing portion 300 which performs a stapling process, a sheet bundle binding device 400 which binds the sheet bundle, and a second folding portion 500.

In the finisher 600, the sheets discharged from the copying machine main body 100 can be processed online. Because sometimes the finisher 600 is used as an optional extra, the copying machine main body 100 can also be used by itself. The finisher 600 and the copying machine main body 100 may integrally be formed.

The finisher 600 includes an entrance roller pair 602 to guide the sheet discharged from the copying machine main body 100 to the inside of the finisher 600. A switch flapper 601 is provided on the downstream side of the entrance roller pair 602. The switch flapper 601 selectively guides the sheet to a side stitch bookbinding path X or a saddle stitching bookbinding path Y. The sheet is guided to a side stitch processing portion 300 through the side stitch bookbinding path X, and the sheet is guided to a saddle stitching processing portion 200 through the saddle stitching bookbinding path Y.

When the switch flapper 601 guides the sheet to the side stitch bookbinding path X, the sheet is delivered toward a buffer roller 605 through a conveying roller pair 603. Predetermined sheets delivered to an outer circumference of the buffer roller 605 are wound around the buffer roller 605 while stacked on.

A punch unit 650 is provided between the conveying roller pair 603 and the buffer roller 605, and the punch unit 650 is operated if needed to make a hole near the rear end of the conveyed sheet.

The sheets delivered to the buffer roller 605 are stacked on a sample tray 621 or on an intermediate processing tray 330 which is of a sheet tacking portion in the side stitch processing portion 300 by the switch flapper 611 disposed on the downstream.

The aligning process is performed to the sheets stacked in the bundle shape on the intermediate processing tray 330 if needed, and the stapling process are performed to a corner part or a back part of the sheets by the stapler 301. Then, discharge rollers 380*a* and 380*b* discharge the sheets onto a stack tray 622.

On the other hand, when the switch flapper 601 guides the sheet to the saddle stitching bookbinding path Y, a conveying roller pair 213 stores the sheet in a storage guide 220 of the saddle stitching processing portion 200, and the sheet is are conveyed until a front end of the sheet abuts on a lifting type sheet positioning member (not illustrated) A stapler 218 is provided on the way to the storage guide 220, and the stapler 218 staples the center of the sheet bundle in cooperation with an anvil 219.

A first folding roller pair 226*a* and 226*b* is provided on the downstream of the stapler 218, and the first folding roller pair 226*a* and 226*b* constitutes a sheet folding portion which folds the sheet bundle. An ejection member 225 is provided while facing the first folding roller pair 226*a* and 226*b*.

In the saddle stitching processing portion 200, after the sheet is conveyed until the front end of the sheet abuts on the lifting type sheet positioning member, the stapler 218 selectively staples the center portions of the sheets, and the sheet bundle is folded. In folding the sheet bundle, the sheet positioning member is lowered such that the sheet bundle stapling position faces a center position (nip) of the first folding roller pair 226*a* and 226*b*.

Then, the ejection member 225 is ejected toward the sheet bundle to tuck the sheet bundle between the first folding roller pair 226*a* and 226*b* (nip), the sheet bundle is conveyed while nipped between the first folding roller pair 226*a* and 226*b*, and the sheet bundle is folded. Therefore, the sheet bundle is formed into a double-folded brochure shape.

The saddle stitching processing portion 200 can perform a process of folding the sheet or sheet bundle without binding the sheet or sheet bundle. In this case, the operation of the stapler 218 is not performed, but only the double-folding process is performed in the above-described processes.

The double-folded sheet is directly conveyed to a second folding portion 500 by the first folding roller pair 226*a* and 226*b*. The second folding portion 500 is of an edge turn-back portion which turns back the sheet to an open edge (non-folded part side) of the sheet.

The second folding portion 500 includes a second folding roller pair 226*b* and 502 and a stopper 501. The stopper 501 is projected toward a sheet conveying path at a position where a distance from the nip between the first folding roller pair 226*a* and 226*b* is shorter than a length in a sheet conveying direction of the sheet (bundle).

The second folding portion 500 includes a second folding member 503. After the double-folded sheet (bundle) abut on the stopper 501, the second folding member 503 is lowered to guide the sheet (bundle) to a nip part between the second folding roller pair 226*b* and 502. A perforation adding device 510 is a perforating portion which perforates the sheet bundle.

In the second folding portion 500, in the case where the binding process is not further performed, the stopper 501 is retracted from the sheet conveyed by the first folding roller pair 226*a* and 226*b*. Therefore, the conveying roller 550 discharges the double-folded sheet to a discharge tray 480.

On the other hand, in the case where the binding process is performed to open edge of the sheet (bundle), the stopper 501 is projected to the sheet conveying path, and therefore the double-folded sheet (bundle) abut on the stopper 501 in the saddle stitching processing portion 200. Then, the second folding member 503 is lowered, and the open edges opposite the folding portions of the sheet (bundle) guided to the nip part between the second folding roller pair 226*b* and 502.

The second folding roller pair 226*b* and 502 performs the folding process to the open edges to convey the open edge to the sheet bundle binding device 400. At this point, the perforation adding device 510 may add the perforation at the position where the sheet (bundle) abuts on the stopper 501 such that the perforation is located inside a range where notch parts are formed in the sheet (bundle). After the perforation is added to the position, the sheet (bundle) is guided to the nip part between the second folding roller pair 226*b* and 502.

Figure 2:
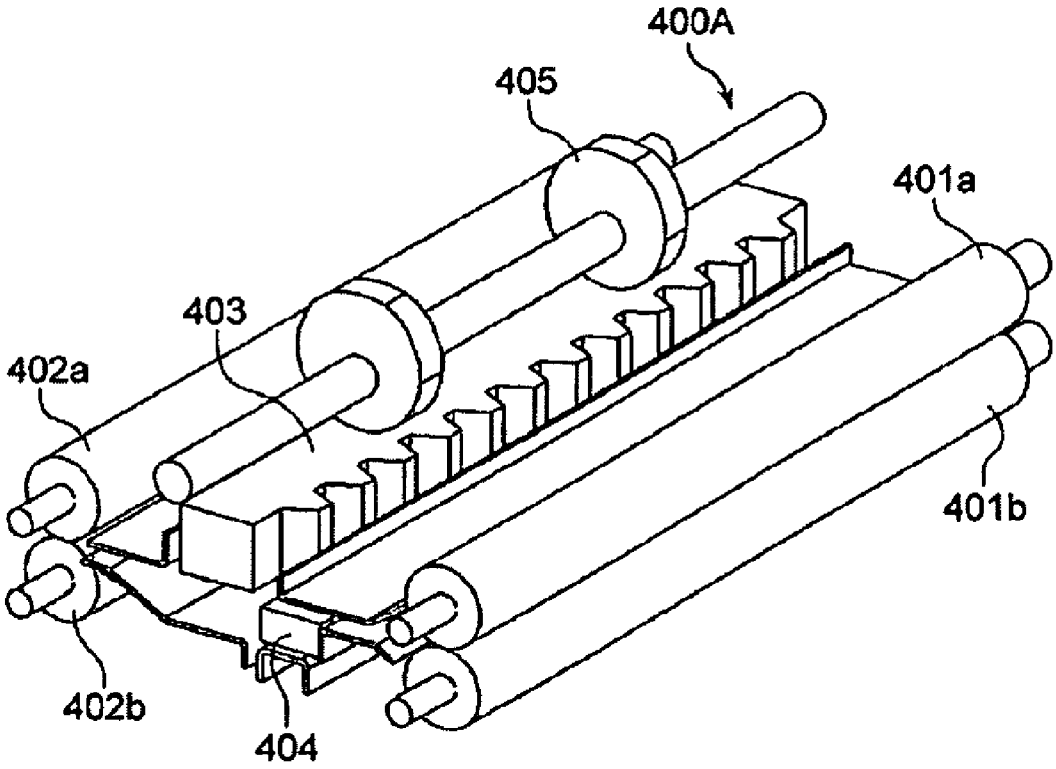
FIG. 2 is a perspective view illustrating a configuration of a sheet bundle binding device provided in the sheet processing apparatus.
Figure 3:
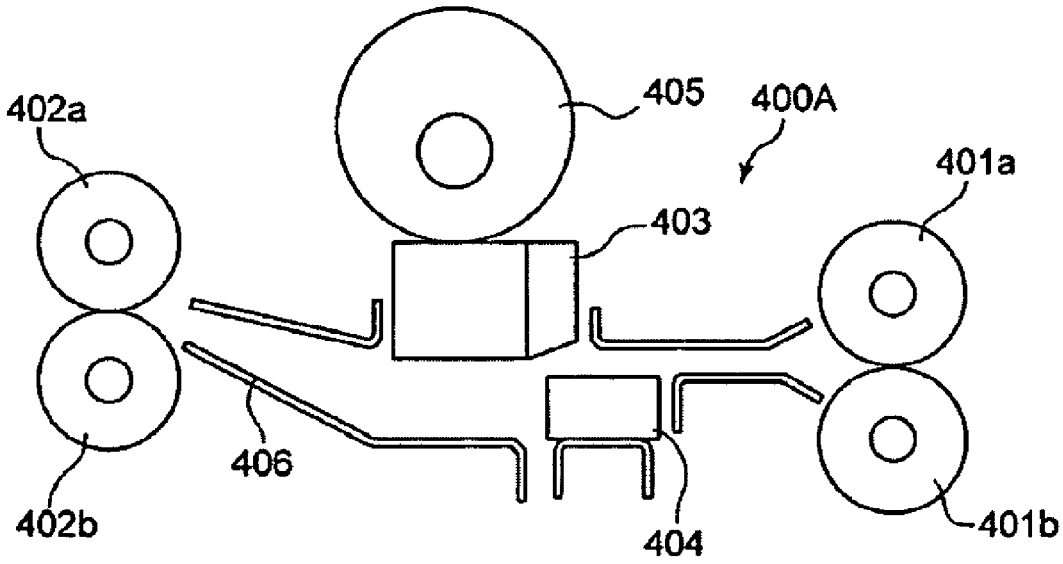
FIG. 3 is a side view illustrating the configuration of the sheet bundle binding device.

As illustrated in FIGS. 2 and 3, the sheet bundle binding device 400 includes a notch part forming portion 400A. The notch part forming portion 400A includes a punch 403, a die 404, and a cam 405 which drives the punch 403. When the cam 405 is driven by a driving source (not illustrated), the punch 403 is vertically moved, which allows the sheet (bundle) to be notched and folded.

In FIGS. 2 and 3, a conveying roller pair 401*a* and 401*b* conveys the sheet (bundle) conveyed from the second folding portion 500 to the notch part forming portion 400A. A discharge roller pair 402*a* and 402*b* constituting a sheet conveying portion is provided on the downstream of the notch part forming portion 400A in the sheet conveying direction, and the discharge roller pair 402*a* and 402*b* discharges (conveys) the sheet (bundle) which the notch part forming portion 400A notches and folds to the discharge tray 480.

Figure 4A:
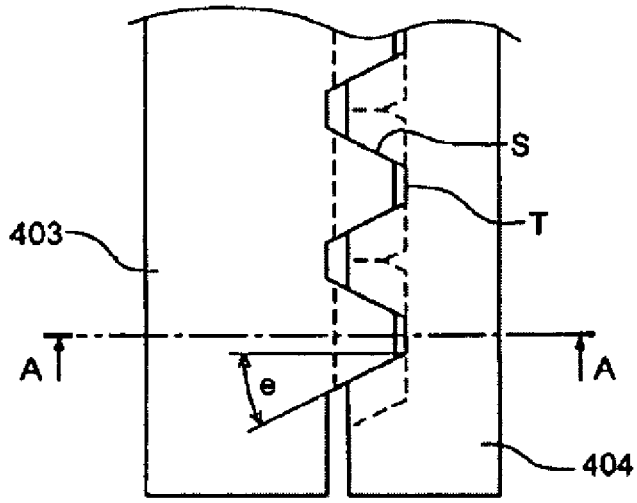
FIG. 4 illustrates a configuration of a binding portion provided in the sheet bundle binding device.
Figure 4B:
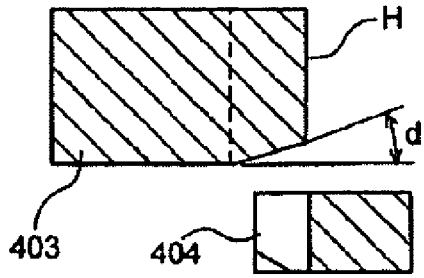

As illustrated in FIG. 4A, plural blades of the punch 403 are provided in a width direction orthogonal to the sheet conveying direction. As illustrated in FIG. 4B, in a blade surface of the punch 403, a angle d is provided from a front end toward a base. Therefore, the notches can be formed in the end part of the sheet (bundle) and the part where the notches are formed in the end part of the sheet (bundle) can be folded downward.

As illustrated in FIG. 4A, an oblique side part S of the die 404 differs from a base part T of the die 404 in a clearance of the die 404 to the punch 403. That is, the clearance of the base part T is set larger than that of the oblique side part S such that the notches can be formed in the sheet (bundle) by the oblique side part S and such that the notch part formed between the notches can be folded by the base part T.

The clearance of the part which is substantially parallel to a side formed between the punch 403 and the die 404 is set broader than the clearance of the part where the notch is formed. Therefore, the notching and folding can be performed by the one notch part forming portion 400A.

Figure 4C:
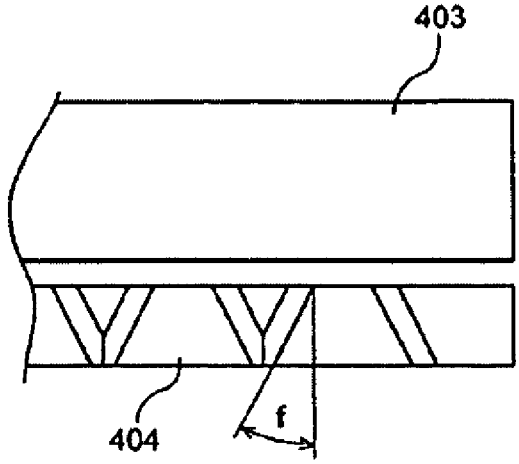

As illustrated in FIG. 4C, a relief angle f is provided in the blade of the die 404. As illustrated in FIG. 4A, the relief angle f is smaller than an angle (not angle) e of the blade of the punch 403 cutting in the sheet (bundle) (e>f). Therefore, the part where the notch is formed can enter the inside of the die 404 without being disturbed by the die 404.

Figure 5:
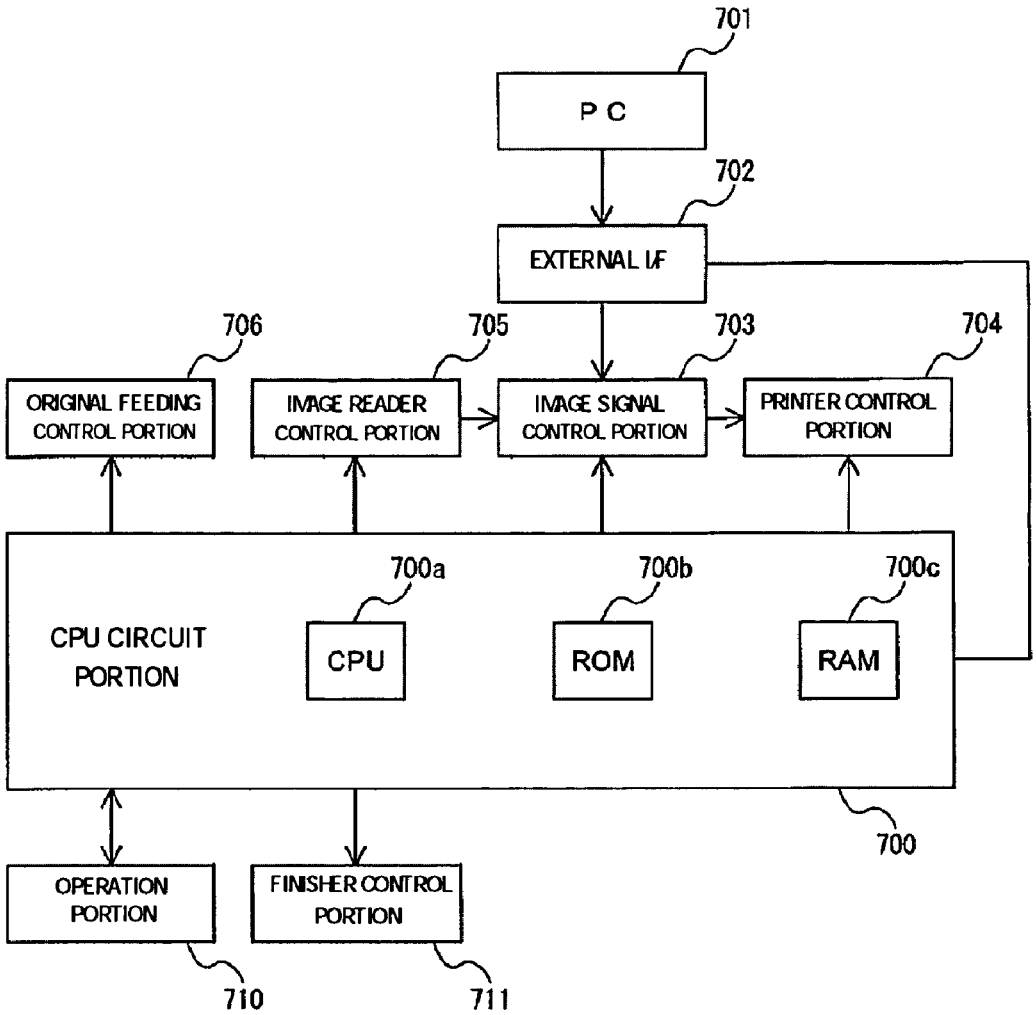
FIG. 5 illustrates a control block diagram of the copying machine.

FIG. 5 illustrates a control block diagram of the copying machine 110. A CPU circuit portion 700 includes CPU 700*a*, ROM 700*b* in which a control program is stored, and RAM 700*c* which is used as an area for temporarily retaining control data or a working area for computation associated with control.

In FIG. 5, an external I/F 702 is an interface between the copying machine 110 and an external PC 701. When the external I/F 702 receives print data from PC 701, the external I/F 702 expands the print data into a bitmap image, and the external I/F 702 supplies the bitmap image in the form of image data to an image signal control portion 703.

The image signal control portion 703 supplies the image data to a printer control portion 704, and the printer control portion 704 supplies the data supplied from the image signal control portion 703 to an exposure control portion (not illustrated). An image reader control portion 705 supplies the image of the original scanned by the image sensor (see FIG. 1) to the image signal control portion 703, and the image signal control portion 703 supplies the image to the printer control portion 704.

An operation portion 710 includes plural keys which set various functions concerning the image formation and display portion which displays a setting state. The operation portion 710 supplies a key signal corresponding to each key operation performed by a user to the CPU circuit portion 700, and the operation portion 710 displays corresponding information on the display portion based on the signal from the CPU circuit portion 700.

On the basis of the control program stored in ROM 700*b* and the setting of the operation portion 710, the CPU circuit portion 700 controls the original feeding portion 104 through an original feeding control portion 706 while controlling the image signal control portion 703.

The CPU circuit portion 700 controls the image reader portion 103 through the image reader control portion 705, and the CPU circuit portion 700 controls the image forming portion 101 through the printer control portion 704. The CPU circuit portion 700 controls the saddle stitching processing portion 200, side stitch processing portion 300, sheet bundle binding device 400, and second folding portion 500 which are provided in the finisher 600 through a finisher control portion 711.

The CPU circuit portion 700 controls the finisher control portion 711 of the finisher 600 based on the process mode fed from and set by the PC 701 or the operation portion 710.

A sheet bundle binding operation of the sheet bundle binding device 400 will be described below.

In the first embodiment, as described above, the second folding member 503 is lowered after the double-folded sheet bundle abuts on the stopper 501. Therefore, the open edge of the sheet bundle is guided to the nip part between the second folding roller pair 226*b* and 502, and the turn-back process is performed by the second folding roller pair 226*b* and 502. That is, the open edge of the sheet bundle is turned back by the second folding roller pair 226*b* and 502.

Figure 6A:
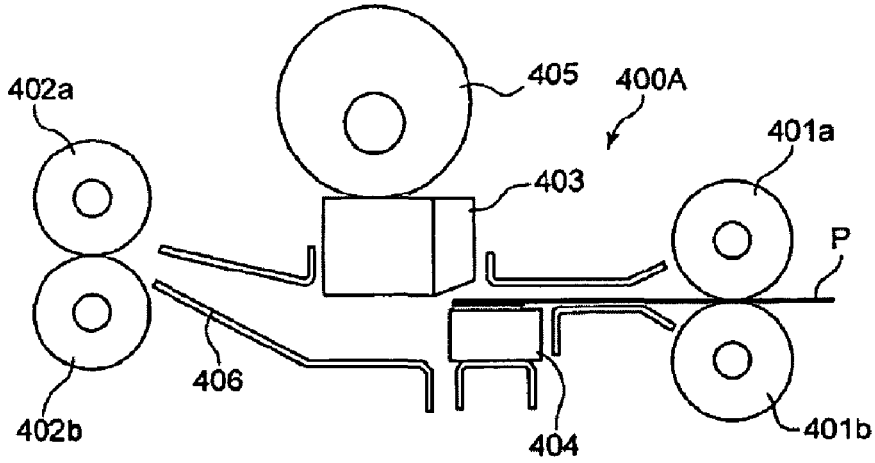
FIG. 6 illustrates a sheet bundle binding operation of the sheet bundle binding device.

Then, the conveying roller pair 401*a* and 401*b* conveys the sheet bundle whose open edge is turned back to the notch part forming portion 400A while the open edge stands at the forefront. The notch part forming portion 400A forms the plural notch parts in the sheet bundle in the width direction orthogonal to the sheet conveying direction. As illustrated in FIG. 6A, an open edge of a sheet bundle P reaches and stops a predetermined position located below the punch 403.

Figure 6B:
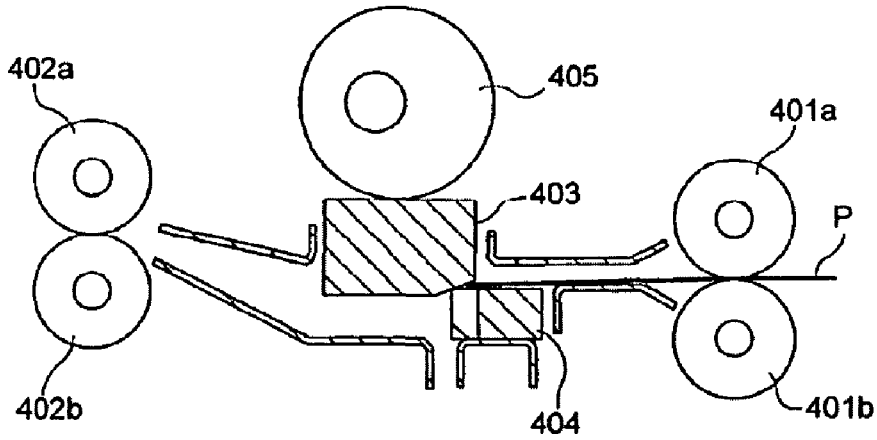

As illustrated in FIG. 6B, the punch 403 is driven through the cam 405 and lowered, thereby forming the plural notch parts in the width direction at the open edge of the sheet bundle P. The punch 403 is lowered even after the notching is ended.

Figure 6C:
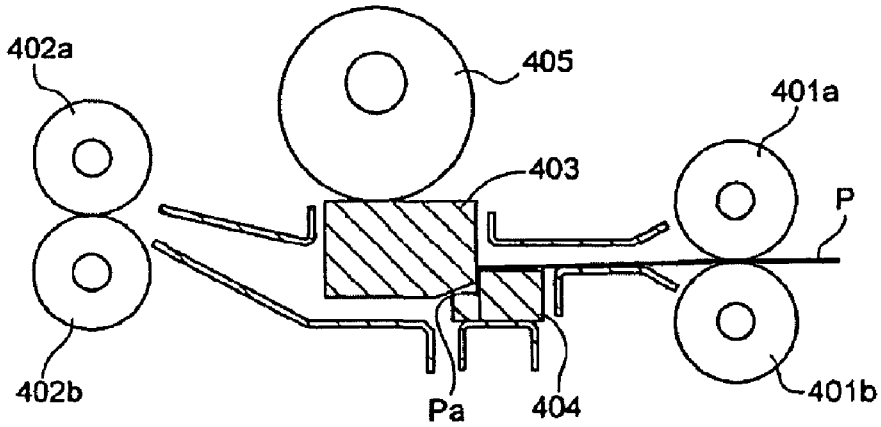
Figure 7:
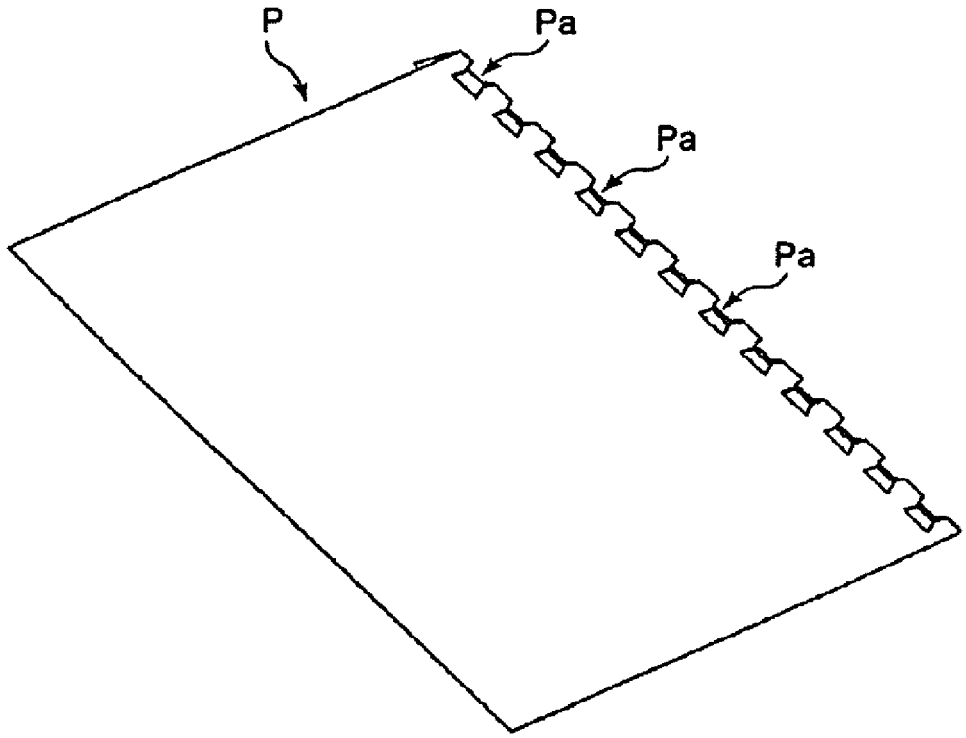
FIG. 7 illustrates a sheet bundle to which the sheet bundle binding device performs a binding process.

Therefore, as illustrated in FIG. 6C, due to the clearance appropriately imparted between the punch 403 and the die 404, the open edge is folded downward at a substantially right angle by the notch, and many notch parts Pa folded downward are formed at the open edge.

Thus, the notch part forming portion 400A forms the plural notches at the open edge of the sheet bundle, the notch parts formed by the notch at the open edge of the sheet bundle are notched and folded every other notch part by one stroke of the punch 403.

In the notch part forming portion 400A, the many notch parts Pa folded at the substantially right angle at the open edge are formed by the notching and folding, the sheet bundle P is conveyed to the discharge roller pair 402*a* and 402*b* by the conveying roller pair 401*a* and 401*b*.

At this point, the nip part between the discharge roller pair 402*a* and 402*b* is shifted upward from an upper surface of the die 404, that is, in the opposite direction to the direction in which the open edge of the sheet bundle is folded. A guide 406 is provided between the notch part forming portion 400A and the discharge roller pair 402*a* and 402*b* to guide the sheet bundle to the discharge roller pair 402*a* and 402*b*.

The guide 406 is inclined such that the open edge to which the notching and the folding are performed is guided to the upwardly-shift nip part between the discharge roller pair 402*a* and 402*b* and such that the sheet discharge direction becomes higher.

When the many notch parts Pa of the sheet bundle P folded downward at the substantially right angle passes through the guide 406, the notch parts Pa are turned back at about 180 degrees by inclining the guide 406.

In order to surely turn back the notch parts Pa, the control may be performed such that the sheet bundle P is stopped once when the notch parts Pa passes through the discharge roller pair 402*a* and 402*b* or such that the notch parts Pa passes through the nip part plural times by switchback. A friction coefficient may be increased by providing irregularities in a surface of the guide 406.

Then, the notch parts Pa are turned back at about 180 degrees by the discharge roller pair 402*a* and 402*b*. The discharge roller pair 402*a* and 402*b* is the sheet binding portion which turns back the notch parts Pa to bind the sheet bundle. Then, the discharge roller pair 402*a* and 402*b* discharges the sheet bundle P to the discharge tray 480. A user opens the sheet bundle P from the notch parts Pa, which allows the sheet bundle P to be used as a usual brochure.

In the case where the perforation is added, the sheet bundle P can be opened by cutting the perforation part formed inside the range where the notch parts Pa of the sheet bundle are formed. The invention also holds well even if the notching and folding are performed without turning back the notch parts to the open edge. In addition to the double-folded sheet bundle, the same effect as the stapling process in which a staple is used even if the notching and folding are performed to the end part of the sheet bundle in which only the predetermined sheets are stacked.

Thus, in the first embodiment, the plural notches are formed at the end part of the sheet bundle, and the notches are folded every other notch to form the plural notch parts Pa. The sheet bundle bound by turning back the plural notch parts Pa formed at the end part of the sheet bundle can easily be opened, and the stapling is not performed, so that the reduction of the running cost can be achieved. Because a sticking material such as glue is not used, contamination of the apparatus can be prevented. Additionally, because the plural notch parts Pa are formed in the end part of the sheet bundle, only the minimal waste stuff is generated when the notch parts Pa are cut to use the usual brochure after the sheet bundle is opened.

Although the sheet bundle is linearly cut in the first embodiment, the cutting shape is not limited to the linear shape. For example, the sheet bundle may be cut in the arc shape. The second folding portion 500 and the notch part forming portion 400A may be unitized and disposed on the downstream side of the side stitch processing portion 300. Therefore, the similar process can be performed to the sheet bundle which is discharged by the discharge roller pair 380 after the stapling process is performed.

Figure 8:
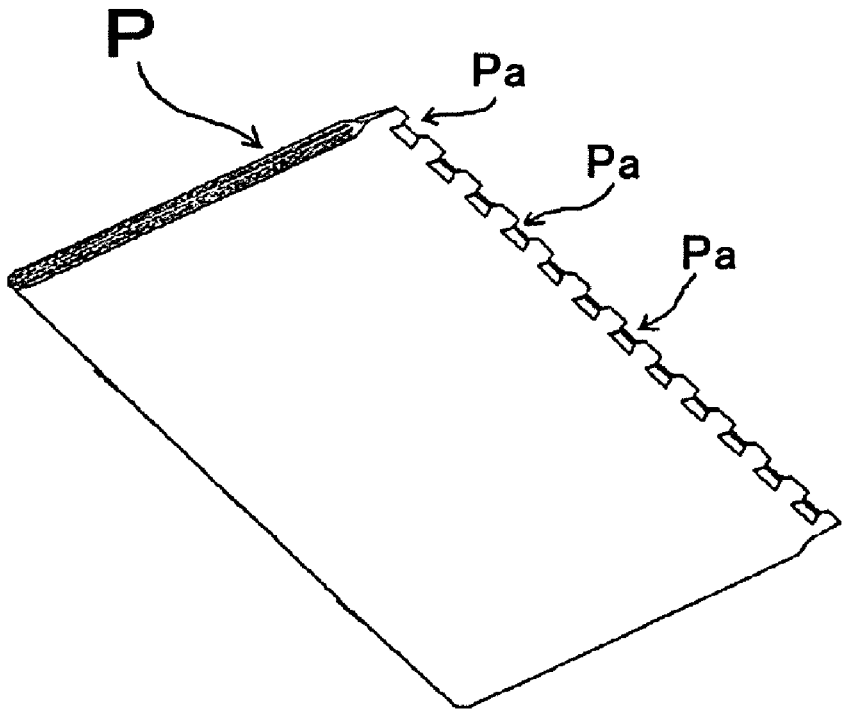
FIG. 8 illustrates another sheet bundle to which the sheet bundle binding device performs the binding process.

A determination whether or not the sheet bundle binding device 400 is operated may be made according to the number of sheets and a sheet thickness of the sheet bundle to which the binding process is performed. The outermost sheet of the sheet bundle which constitutes a front cover of the brochure is formed by a sheet having a different size, and the plural notch parts may be formed at the open edge of the sheet projected from other sheets when the sheet bundle is folded. That is, the sheet which is longer than other sheets constituting the filling is supplied, and the binding process may be performed by performing the cutting and folding to the sheet. FIG. 8 illustrates the product obtained by the above-described manner.

In the first embodiment, the notch parts are formed at the open edge of the double-folded sheet bundle. Alternatively, the notch parts may be formed in the folded parts of the double-folded sheet (bundle) to tentatively bind the sheet bundle.

A second embodiment of the invention will be described below. In the second embodiment of the invention, the notch parts are formed in the folded part of the double-folded sheet bundle.

Figure 9:
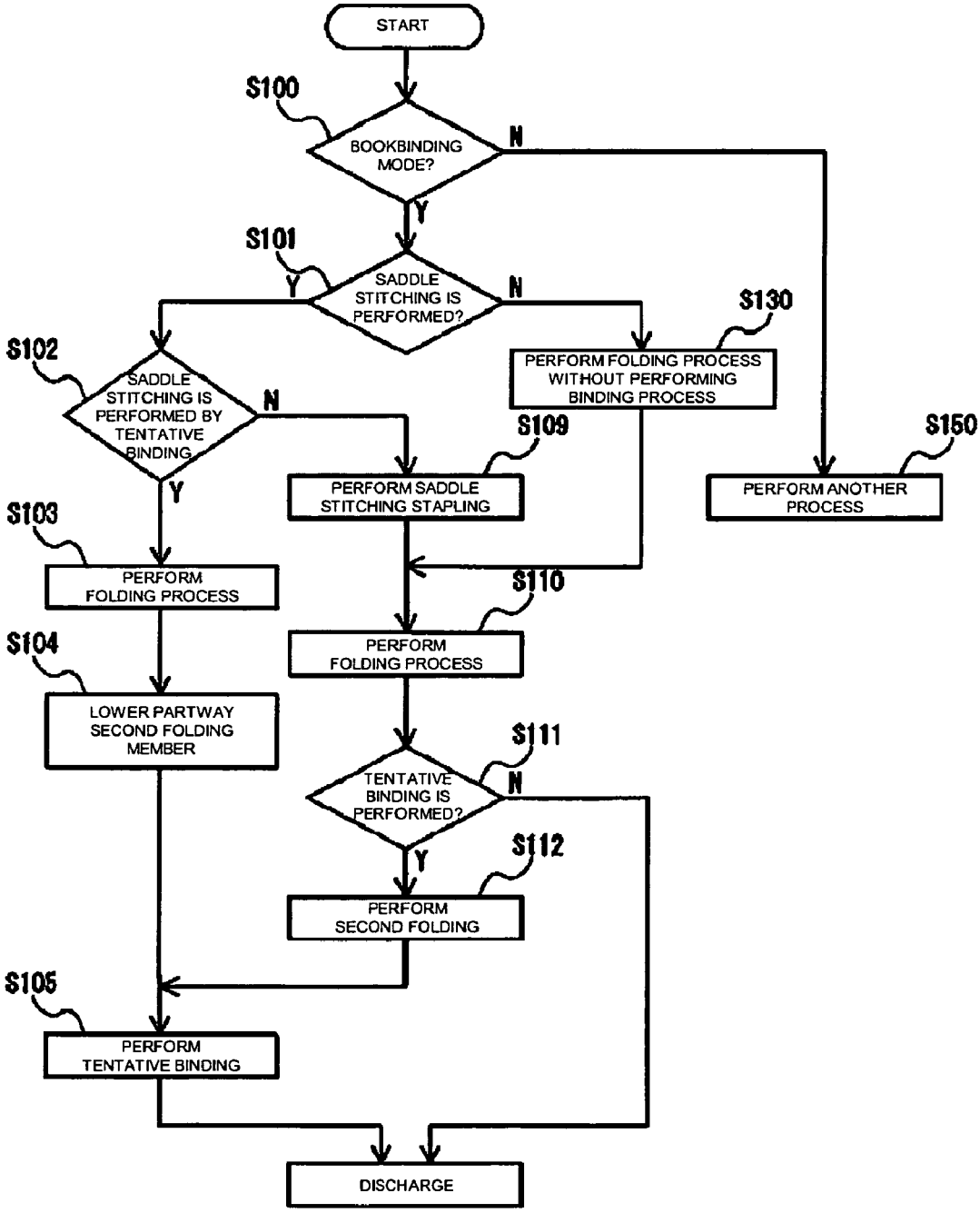
FIG. 9 is a flowchart illustrating a control operation of a sheet bundle binding device according to a second embodiment of the invention.

FIG. 9 is a flowchart illustrating a control operation of the sheet bundle binding device 400 of the second embodiment.

In the second embodiment, a determination of a bookbinding mode is made (S100). In the bookbinding mode, the bookbinding is performed to the sheet bundle. In the case of the bookbinding mode (Y in S100), it is determined whether the saddle stitching is performed or the notch parts are formed at the open edge without performing the saddle stitching (S101). In the case of not the bookbinding mode (N in S100), another process is performed (S150).

In the case where the saddle stitching is performed (Y in S101), a method of performing the saddle stitching process is determined. That is, it is determined whether the saddle stitching is tentatively bound or stapled (S102). In the case where the saddle stitching is tentatively bound (Y in S102) the saddle stitching processing portion 200 performs the folding process (S103). That is, the saddle stitching processing portion 200 performs not the stapling process but the double-folding process.

The second folding member 503 provided in the second folding portion 500 is previously lowered partway (S104). Therefore, the folded part of the double-folded sheet bundle abuts on the second folding member 503. Then, the sheet bundle is guided to the nip part between the second folding roller pair 226*b* and 502 while the folded part stands at the forefront, and the sheet bundle passes through the second folding roller pair 226*b* and 502.

In the sheet bundle binding device 400, the notch part forming portion 400A performs the tentative binding process as described in the first embodiment. That is, the notch parts are provided in the folded part of the sheet bundle to perform the tentative binding (S105). After the tentative binding, the discharge roller pair 402*a* and 402*b* discharges the sheet bundle.

In the case where the saddle stitching is not formed by the tentative binding (N in S102), that is, in the case where the saddle stitching is performed by the stapling, saddle stitching stapling is performed (S109), and the saddle stitching processing portion 200 performs the folding process (S110).

In the case where the tentative binding is performed to the open edge (Y in S111), similarly to the first embodiment, the second folding is performed. That is, the sheet bundle is conveyed to the nip part between the second folding roller pair 226*b* and 502 while the open edge stands at the forefront, and the open edge of the sheet bundle is turned back. Then, the tentative binding is performed to the turned-back open edge of the sheet bundle (S112).

In the case where the tentative binding is not performed after the folding process is performed (N in S111), the conveying roller 550 directly discharges the sheet bundle. In the case where the saddle stitching is not performed (N in S101), the saddle stitching processing portion 200 performs the folding process without performing the binding process (S130).

In the case where the notch parts are formed to tentatively binding the open edge (Y in S111), similarly to the first embodiment, the sheet bundle is conveyed to the nip part between the second folding roller pair 226*b* and 502 while the open edge stands at the forefront, and the second folding is performed (S112). Then, the turned-back open edge of the sheet bundle is tentatively bound (S105). In the case where the tentative binding is not performed (N in S111), the conveying roller 550 directly discharges the sheet bundle.

As described above, in the second embodiment, the notch parts are formed in the folded part of the double-folded sheet bundle to tentatively bind the sheet bundle. Therefore, the staple which is necessary in the conventional saddle stitching bookbinding can be eliminated to reduce the running cost.

A third embodiment of the invention will be described below.

Figure 10:
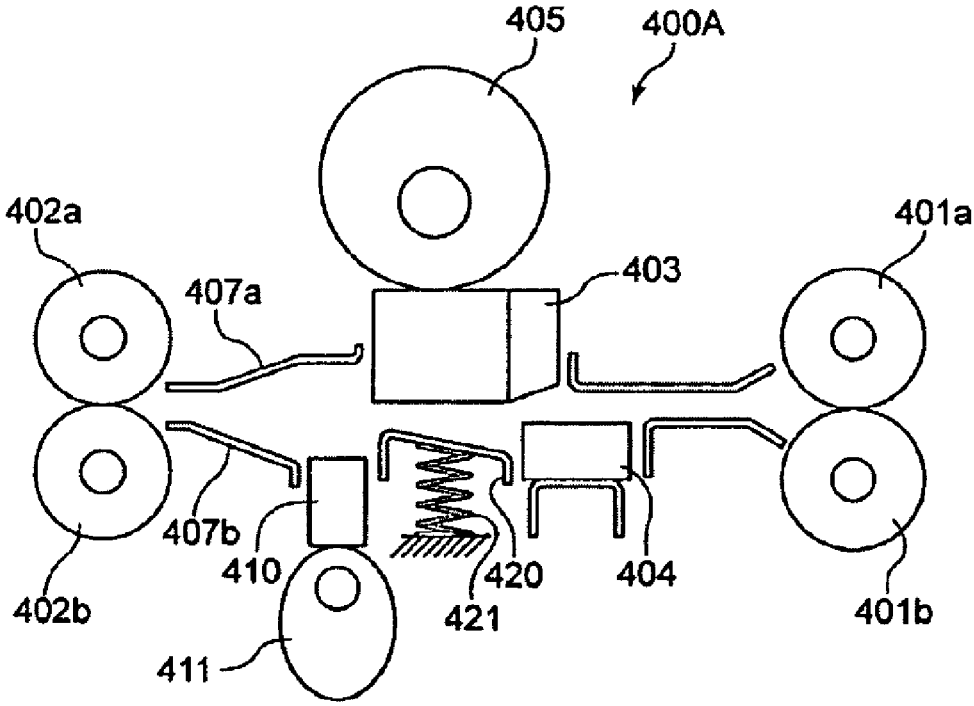
FIG. 10 illustrates a configuration of a sheet bundle binding device provided in a sheet processing apparatus according to a third embodiment of the invention.

FIG. 10 illustrates a configuration of a sheet bundle binding device provided in a sheet processing apparatus of the third embodiment. In FIG. 10, the same or equivalent component as that of FIG. 3 is designated by the same numeral.

Referring to FIG. 10, a second punch 410 is formed into a substantially rectangular solid shape, and second punch cam 411 lifts and lowers the second punch 410. The second punch 410 is disposed with a proper clearance in the sheet conveying direction with respect to the punch 403, and the second punch 410 is lifted and lowered through the second punch cam 411 by a driving source (not illustrated).

A movable guide plate 420 is provided between the die 404 and the second punch 410, and a biasing spring 421 applies a force to the movable guide plate 420. Usually the biasing spring causes the movable guide plate 420 to but on a latching portion (not illustrated) provided above, thereby positioning the movable guide plate 420.

A sheet bundle binding operation performed by the sheet bundle binding device of the third embodiment will be described below.

In the case where the sheet binding process is performed to the open part of the sheet (bundle), the double-folded sheet bundle abuts on the stopper 501 in the saddle stitching processing portion 200. Then, the second folding member 503 is lowered, and the open edge opposite the saddle stitching part of the sheet bundle or the open edge opposite the folded part is guided to the nip part between the second folding roller pair 226*b* and 502.

Then, the second folding roller pair 226*b* and 502 performs the turn-back processing to the open edge, and the sheet bundle is conveyed to the notch part forming portion 400A. The sheet bundle may be conveyed to the notch part forming portion 400A after the perforation adding device 510 perforates the sheet bundle at the position where the sheet bundle abuts on the stopper 501.

Figure 11A:
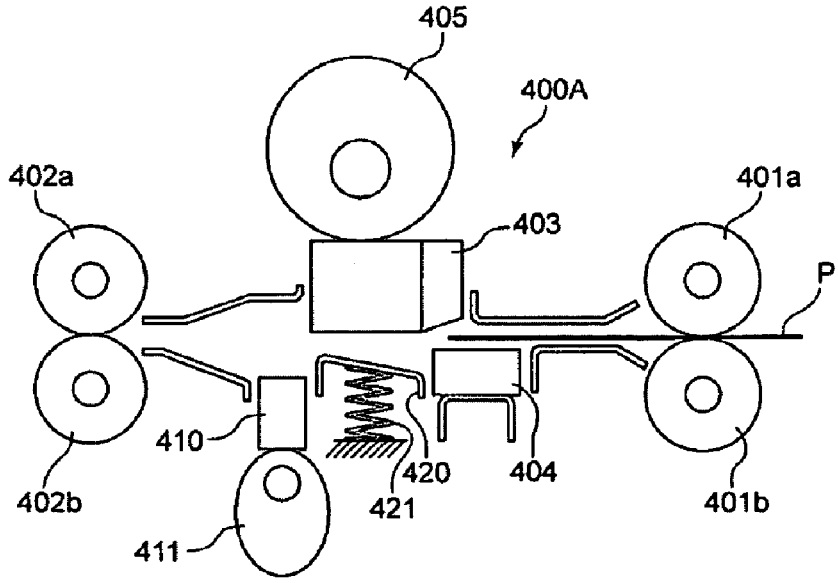
FIG. 11 is a first view illustrating a sheet bundle binding operation of the sheet bundle binding device of the third embodiment.

Then, the conveying roller pair 401*a* and 401*b* conveys the sheet bundle whose open edge is turned back to the notch part forming portion 400A while the open edge stands at the forefront. Then, as illustrated in FIG. 11A, the sheet bundle P stops when the open edge reaches a predetermined position below the punch 403.

Figure 11B:
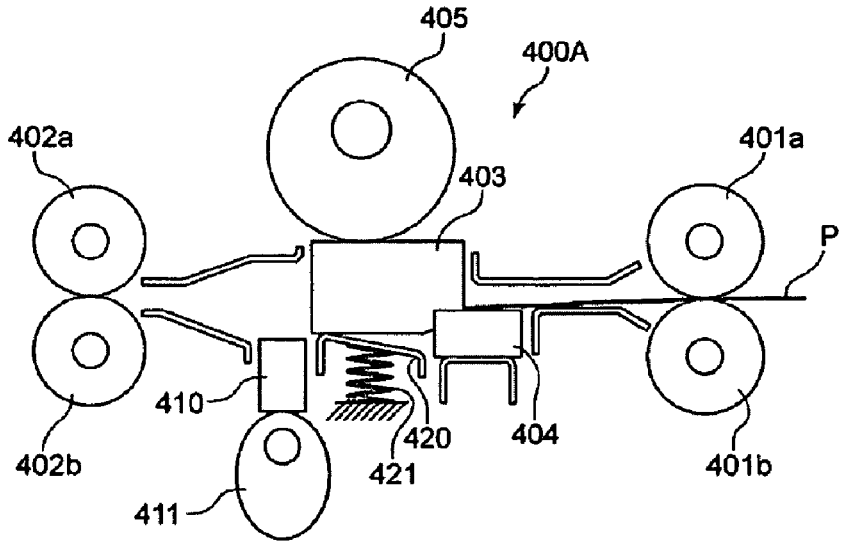

As illustrated in FIG. 11B, the punch 403 is lowered to form the plural notches in the width direction at the open edge of the sheet bundle P. The punch 403 is lowered even after the notching is ended. Therefore, the open edge is folded downward at the substantially right angle by the clearance properly imparted between the die 404 and the open edge, and the many notch parts are formed in the open edge while folded downward. At this point, because the movable guide plate 420 is pushed down by the punch 403, the movable guide plate 420 does not interrupt the movement of the punch 403.

Figure 12A:
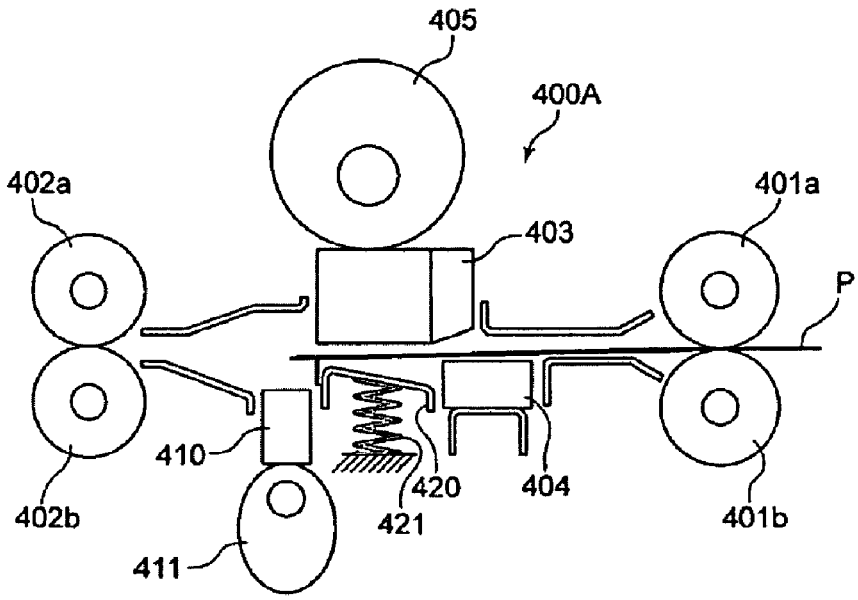
FIG. 12 is a second view illustrating the sheet bundle binding operation of the sheet bundle binding device of the third embodiment.

After the notching and folding are performed, the punch 403 is lifted. When the punch 403 is lifted, the biasing spring 421 returns the movable guide plate 420 to the original position at which the sheet bundle P is guided toward the second punch 410. Then, the sheet bundle P is conveyed to a predetermined amount, and the sheet bundle P stops at the position where only the open edge to which the folding is not performed overlaps the second punch 410 as illustrated in FIG. 12A. Then, the second punch 410 is driven and lifted through the second punch cam 411.

Figure 12B:
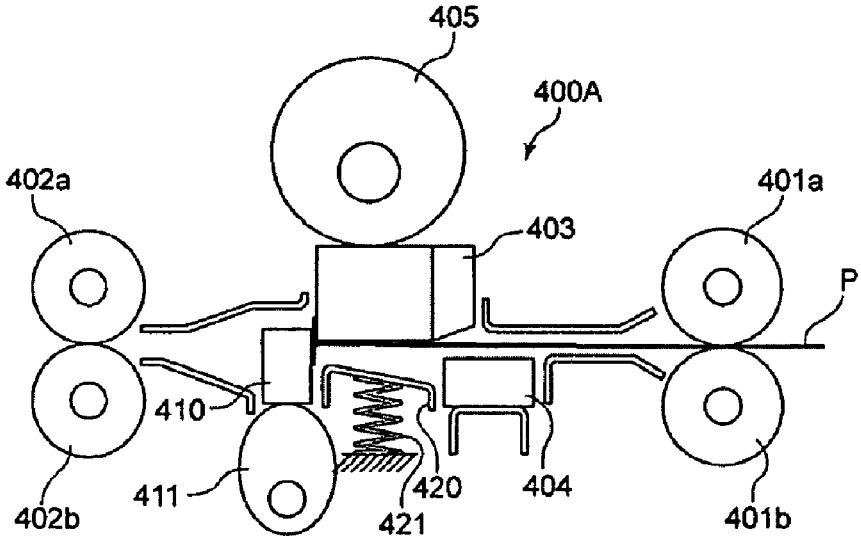
Figure 13:
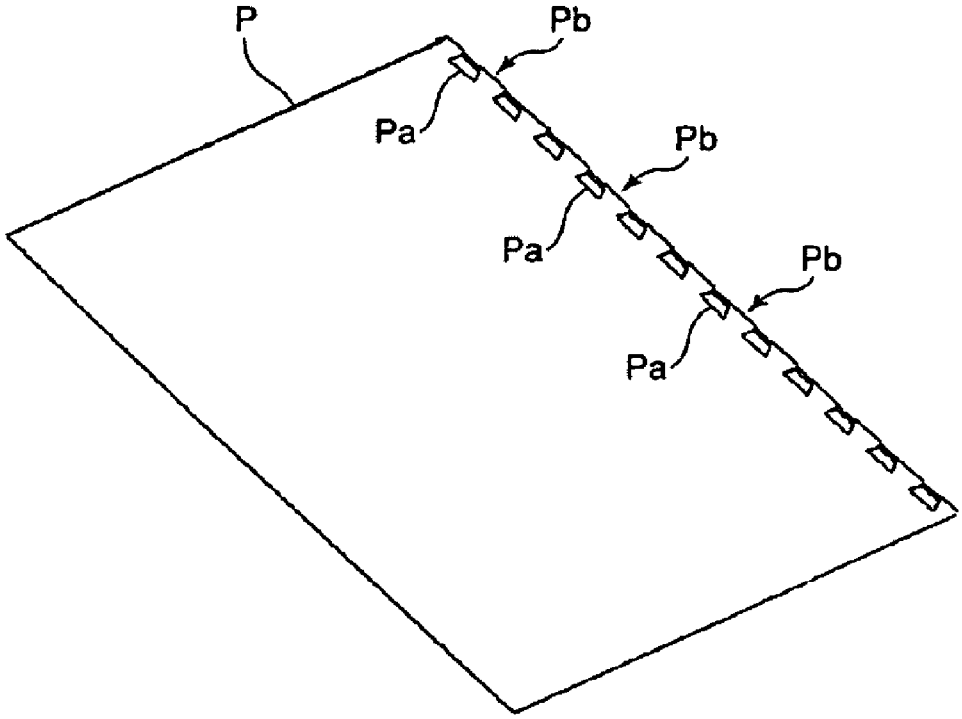
FIG. 13 illustrates a sheet bundle to which the sheet bundle binding device of the third embodiment performs the binding process.

Therefore, as illustrated in FIG. 12B, the open edge to which the folding is not performed in the punch 403 and the die 404 by the clearance properly imparted between punch 403 and the second punch 410 is folded upward at the substantially right angle by the notches, and whereby the many notch parts Pa and Pb are formed at the open edge while alternatively folded upward and downward as illustrated in FIG. 13.

An upper guide 407*a* and a lower guide 407*b* are provided between the notch part forming portion 400A and the discharge roller pair 402*a* and 402*b* in order to guide the sheet bundle to the discharge roller pair 402*a* and 402*b*.

In order to guide the open part to which the folding process is performed to the nip part between the discharge roller pair 402*a* and 402*b*, the upper guide 407*a* is inclined so as to be lowered toward the sheet discharge direction, and the lower guide 407*b* is inclined so as to be raised toward the sheet discharge direction.

Because the upper and lower guides 407*a* and 407*b* are inclined, the many notch parts Pa and Pb folded upward and downward at the substantially right angle are turned back at about 180 degrees as shown in FIG. 13 when passing through the upper and lower guides 407*a* and 407*b*.

In order to surely turn back the notch parts Pa and Pb, the sheet bundle may be caused to stop tentatively or switchback to pass through the nip part plural times when the sheet bundle passes through the discharge roller pair 402*a* and 402*b*. The friction coefficient may be increased by providing the irregularities in surfaces of the upper and lower guides 407*a* and 407*b*.

The notch parts are turned back at about 180 degrees to bind the sheet bundle, and the discharge roller pair 402*a* and 402*b* discharges the sheet bundle to the discharge tray 480. Then, a user opens the sheet bundle P from the notch parts Pa and Pb, which allows the sheet bundle P to be used as a usual brochure.

As described above, in the third embodiment, the plural notch parts are formed in the end part of the sheet bundle, and the notch parts are alternately folded upward and downward to form the plural notch parts Pa and Pb. The plural upper and lower notch parts Pa and Pb are formed in the end part of the sheet bundle, whereby the bound sheet bundle can easily be opened and the reduction of the running cost can be achieved.

In the third embodiment, the many notch parts Pa and Pb are alternately folded upward and downward in the sheet bundle to which the saddle stitching is performed or the open edge of the double-folded sheet bundle. Alternatively, the sheet bundle may tentatively be bound by forming the many notch parts in upper and lower parts of the folded part of the double-folded sheet bundle.

In such cases, when the saddle stitching processing portion 200 does not perform the stapling process but the first folding roller pair 226*a* and 226*b* performs the double-folding process, the second folding member 503 provided in the second folding portion 500 is previously lowered partway.

The folded part of the sheet bundle conveyed from the first folding roller pair 226*a* and 226*b* is guided to the second folding roller pair 226*b* and 502. Then, the notch part forming portion 400A can perform the saddle stitching by performing the process of the notch part forming portion 400A of the second embodiment. Therefore, the staple which is necessary in the conventional saddle stitching bookbinding can be eliminated to reduce the running cost.

In the embodiments, the notch part forming portion cuts the end portion of the sheet bundle to form the plural notch parts, and the plural notch parts are folded. The invention is not limited to the embodiments.

For example, the notch part forming portion performs the folding while performing the notching, which facilitates the turn-back process of the sheet binding portion. The notch parts Pa to which the sheet binding portion performs only the notching may be turned back at about 180 degrees.

In the sheet bundle binding process in which the commercially available tape is used to bind the sheet bundle, when the sheet bundle is largely opened or when the sheet bundle is repeatedly opened and closed, unfortunately an binding force between the glue of the edge part of the sheet bundle and the sheet is decreased and the sheet in the sheet bundle drops out.

However, in the sheet bundle binding process in which the commercially available tape is used to bind the sheet bundle, the product illustrated in FIG. 13 is formed as a pre-process of preventing the drop-out of the sheet in binding the sheets with the tape, whereby the sheet in the sheet bundle does not drop out.

The punch 403 and die 404 which are of a die set or the constituting the notch part forming portion 400A or second punch 410 is divided in a longitudinal direction and independently driven, whereby only a part of the sheet or the edge part of the sheet bundle can be notched and folded.

In the embodiments, the finisher (sheet processing apparatus) 600 including the sheet bundle binding device 400 is connected to the copying machine main body 100. Alternatively, the finisher (sheet processing apparatus) 600 may independently be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-182873, filed Jul. 12, 2007, which is hereby incorporated by reference herein in its entirety.

What is claimed is:

1. A sheet processing apparatus for processing a sheet or a sheet bundle, the sheet processing apparatus comprising:

a notch part forming portion which forms a plurality of notch parts in an end part of a sheet or a sheet bundle, each notch part including a base part and an oblique side part that is cut off from the sheet on both sides of the base part; and a sheet binding portion which turns back the plurality of notch parts to bind the sheet or the sheet bundle, wherein the notch part forming portion includes a punch and a die, wherein a clearance between the punch and the die in a part parallel to the end part of the sheet bundle is set larger than a clearance between the punch and the die in a part where the notch is formed, and wherein each of the punch and the die has a blade for cutting the oblique side part, a blade surface of the punch has a gradient with respect to a blade surface of the die, and the blade of the die has an angle smaller than an angle of the blade of the punch.

2. The sheet processing apparatus according to claim 1, further comprising:

a sheet folding portion which folds sheets, wherein the notch part forming portion forms the plurality of notch parts at another end part of the sheet bundle folded by the sheet folding portion.

3. The sheet processing apparatus according to claim 2, wherein the end part of the sheet bundle is an open edge opposite the folded part of the sheet bundle folded by the sheet folding portion.

4. The sheet processing apparatus according to claim 3, further comprising:

an end part turn-back portion which turns back the open edge opposite the folded part of the sheet bundle folded by the sheet folding portion, wherein the end part of the sheet bundle is the open edge of the sheet bundle turned back by the end part turn-back portion.

5. The sheet processing apparatus according to claim 2, wherein the end part of the sheet bundle is the folded part of the sheet bundle folded by the sheet folding portion.

6. The sheet processing apparatus according to claim 1, further comprising:

a sheet folding portion which folds a sheet, wherein the end part of the sheet is an open edge opposite the folded part of the sheet folded by the sheet folding portion.

7. The sheet processing apparatus according to claim 1, further comprising:

a sheet folding portion which folds a sheet; and an end part turn-back portion which turns back an open edge opposite the folded part of the sheet folded by the sheet folding portion, wherein the end part of the sheet is the open edge of the sheet turned back by the end part turn-back portion.

8. The sheet processing apparatus according to claim 1, further comprising:

a sheet folding portion which folds a sheet, wherein the end part of the sheet bundle is the folded part of the sheet folded by the sheet folding portion.

9. The sheet processing apparatus according to claim 1, further comprising:

a sheet folding portion which folds the sheets, wherein a sheet which is longer than other sheets contained in the folded sheet bundle, is supplied to an outermost sheet, and the notch part forming portion forms the plurality of notch parts at an open edge of the outermost sheet projected from the open edge of other sheets when the sheet bundle is folded by the sheet folding portion.

10. The sheet processing apparatus according to claim 1, wherein the notch part forming portion notches an end part of the sheet bundle to form the plurality of notch parts, and the notch part forming portion folds the plurality of notch parts every other notch part.

11. The sheet processing apparatus according to claim 10, wherein the sheet binding portion is a sheet conveying portion provided on a downstream side of the notch part forming portion, and the sheet conveying portion causes the sheet to stop or switchback when the plurality of folded notch parts of the sheet bundle pass through the sheet conveying portion.

12. The sheet processing apparatus according to claim 11, wherein a guide which guides the sheet bundle is provided between the sheet conveying portion and the notch part forming portion while inclined toward the sheet conveying portion.

13. The sheet processing apparatus according to claim 11, wherein the sheet conveying portion is provided while shift toward an opposite direction to a direction in which the notch part forming portion turns back the sheet bundle.

14. The sheet processing apparatus according to claim 1, wherein the notch part forming portion alternately folds the plurality of notch parts while notching the end part of the sheet bundle to form the plurality of notch parts.

15. The sheet processing apparatus according to claim 14, wherein the sheet binding portion is a sheet conveying portion provided on a downstream side of the notch part forming portion, and the sheet conveying portion causes the sheet to stop or switchback when the plurality of folded notch parts of the sheet bundle pass through the sheet conveying portion.

16. The sheet processing apparatus according to claim 15, wherein a guide which guides the sheet bundle is provided between the sheet conveying portion and the notch part forming portion while inclined toward the sheet conveying portion.

17. The sheet processing apparatus according to claim 1, further comprising a perforating portion which perforates the sheet bundle inside a range where the notch parts are formed.

18. The sheet processing apparatus according to claim 1, wherein the notch part forming portion is operated according to the number of sheets and a thickness of the sheet bundle.

19. An image forming apparatus comprising:

an image forming portion which forms an image on a sheet; and the sheet processing apparatus which processes the sheet on which the image is formed, wherein the sheet processing apparatus comprises:

a notch part forming portion which forms a plurality of notch parts in an end part of a sheet or a sheet bundle, each notch part including a base part and an oblique side part that is cut off from the sheet on both sides of the base part; and a sheet binding portion which turns back the plurality of notch parts to bind the sheet or the sheet bundle, wherein the notch part forming portion includes a punch and a die, wherein a clearance between the punch and the die in a part parallel to the end part of the sheet bundle is set larger than a clearance between the punch and the die in a part where the notch is formed, and wherein each of the punch and the die has a blade for cutting the oblique side part, a blade surface of the punch has a gradient with respect to a blade surface of the die, and the blade of the die has an angle smaller than an angle of the blade of the punch.

* * * * *